US006988296B1

(12) United States Patent
McGarity et al.

(10) Patent No.: US 6,988,296 B1
(45) Date of Patent: Jan. 24, 2006

(54) COMBINATION MONEY CLIP AND TRANSMITTING AND RECEIVING DEVICE

(76) Inventors: Ronald M. McGarity, 150 Interlochen Dr., Peachtree City, GA (US) 30169; Erich McArthur, 688 Chicken Lyle Rd., Winder, GA (US) 30680

( * ) Notice: Subject to any disclaimer, the term of this patent is extended or adjusted under 35 U.S.C. 154(b) by 0 days.

(21) Appl. No.: 10/785,440

(22) Filed: Feb. 24, 2004

Related U.S. Application Data

(63) Continuation-in-part of application No. 10/222,347, filed on Aug. 15, 2002, now abandoned.

(60) Provisional application No. 60/314,000, filed on Aug. 21, 2001.

(51) Int. Cl.
*B42F 1/00* (2006.01)

(52) U.S. Cl. ..... 24/67.3; 24/536; 24/67.5; 24/558

(58) Field of Classification Search ..... 24/3.1, 24/3.11–3.13, 67 R, 67.3–67.9, 530, 535, 24/536, 330, 331, 557, 558, 545, 494–496, 24/565, 502, 508, 511; 224/195, 930, 197–200, 224/270–272
See application file for complete search history.

(56) References Cited

U.S. PATENT DOCUMENTS

| | | | | | |
|---|---|---|---|---|---|
| 867,255 | A | * | 10/1907 | Dietz | 24/3.6 |
| 5,730,342 | A | * | 3/1998 | Tien | 224/271 |
| 5,906,031 | A | * | 5/1999 | Jensen | 24/3.12 |
| 5,927,580 | A | * | 7/1999 | Ward-Llewellyn | 224/272 |
| 5,946,778 | A | * | 9/1999 | McGarity | 24/536 |
| 6,161,741 | A | * | 12/2000 | French | 224/198 |
| 6,205,257 | B1 | * | 3/2001 | Eschbach | 382/261 |
| 6,736,136 | B2 | * | 5/2004 | Chen-Lieh | 24/3.11 |

* cited by examiner

*Primary Examiner*—Robert J. Sandy
*Assistant Examiner*—Ruth C. Rodriguez
(74) *Attorney, Agent, or Firm*—Rodgers & Rodgers

(57) ABSTRACT

A money clip having jaws connected by a throat that provides spring action to urge the jaws together, a pair of operating levers slidably mounted respectively on the jaws, and a device that emits and receives radio waves, electromagnetic waves, light waves, sound waves, microwaves or a combination thereof and other electronic media for the purpose of transmitting and receiving wireless data from and to other base transmitters/receivers being disposed on one of the operating levers.

5 Claims, 6 Drawing Sheets

FIG.6
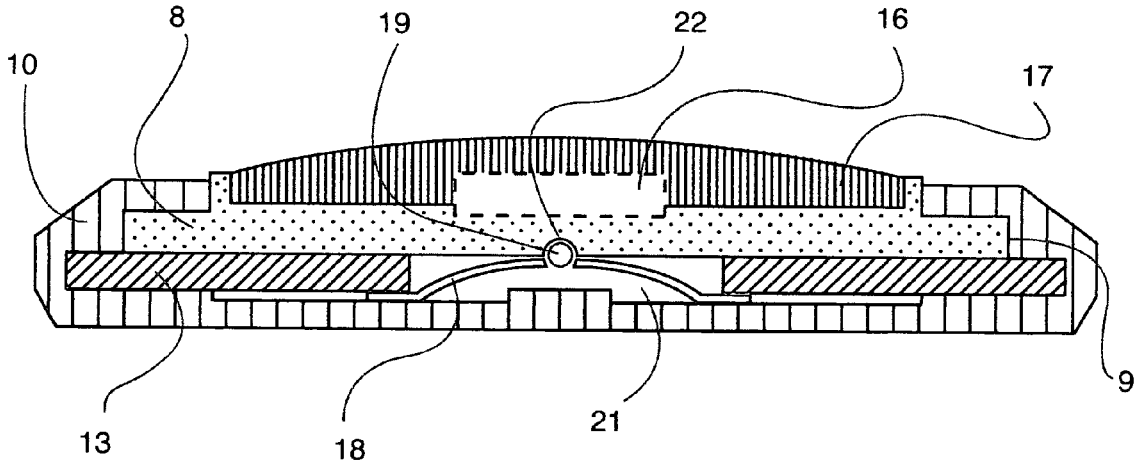
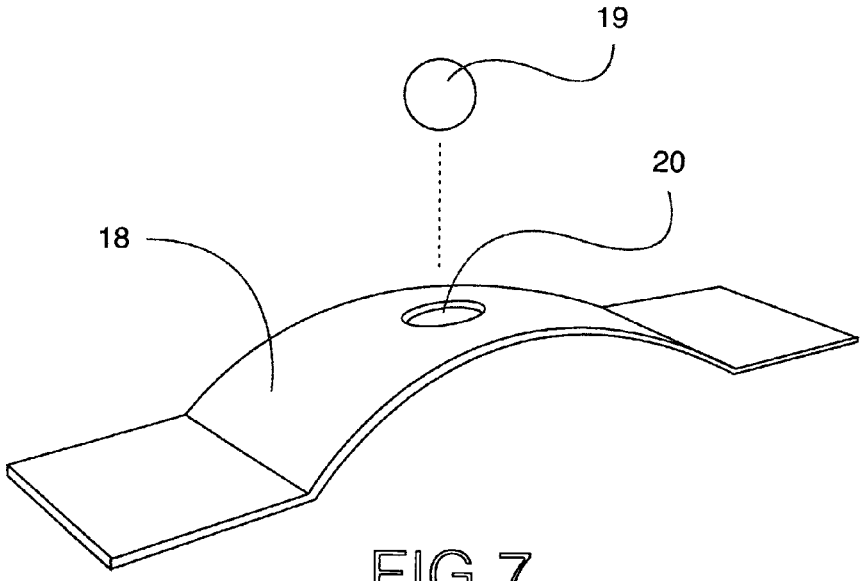
FIG.7

COMBINATION MONEY CLIP AND TRANSMITTING AND RECEIVING DEVICE

The benefits under 35 U.S. C. 119 are claimed of provisional application 60/314,000 filed Aug. 21, 2001.

This is a continuation-in-part of application Ser. No. 10/222,347 filed Aug. 15, 2002, now abandoned.

BACKGROUND OF THE INVENTION

This invention relates specifically to money clips and the like and is more particularly concerned with an aesthetically designed clip that incorporates a transmitting and receiving device that allows the money clip to function as a new type of platform from which electronic transactions can be initiated, received and completed.

Clips for holding a great variety of items, are well known in the art. Such clips generally comprise a simple pair of jaws that are normally urged toward each other. It is desirable to have a money clip that will also function as a platform to facilitate certain electronic transactions to be completed that have now become both common, convenient and desired in the world of data and information transfer. As a result of this, the clip is constructed with one or more bosses such that it will allow for the incorporation of the appropriate electronic device that may initiate and complete these types of electronic transactions in combination with a pair of levers that extend for opening the clip and retract when not in use.

Money clips used to clip paper currency together and the like have not had electronic devices included in their design as part of their overall functionality in the past. Such clips are normally simple spring clips, perhaps with a rampway to assist sliding the clip onto the contents being held. The inclusion of an electronic device allows the money clip to become a transmitting/receiving platform for multiple types of electronic actions or transactions.

BRIEF SUMMARY OF THE INVENTION

The present invention provides a spring urged money clip having generally flat jaws and a resilient throat for urging the jaws together. A pair of levers are slidably mounted respectively on the jaws to open clip. The money clip is designed to include the mounting and inclusion of an electronic device on or inside the clip which may be used for the purpose of receiving and transmitting electronic data and which facilitates the completion of multiple types of electronic transactions, originating, continuing or terminating at the clip. The electronic functionality of the money clip may be activated and terminated by the user as desired.

The clip is adapted to emit and receive electromagnetic waves, radio waves, sound waves, laser light, and/or microwaves for the purpose of transmitting and receiving wireless data from and to other transmitters/receivers. These data are utilized to facilitate the creation and completion of wireless electronic transactions that can accommodate the movement of data from and to the clip to as needed to complete such transactions. The money clip with the included electronic device creates a very convenient platform from which various financial transactions can take place using the data that is accessed via the electronic device to initiate and complete purchases, ultimately charging them to a customer's selected charge accounts, checking accounts, savings accounts, etc. The clip's design and functionality may also be used for nonfinancial transactions.

The clip of the present invention may be made inexpensively, such as of plastic, polymeric materials or inexpensive metal, or can be made from more expensive metals and may even include plating of precious metal and decoration with hides, gem stones, etc. The clip may have a very strong spring force to hold things together, or may have a weak spring force to hold money, a few papers, credit cards or the like.

BRIEF DESCRIPTION OF THE SEVERAL VIEWS OF THE DRAWINGS

These and other features and advantages of the present invention will become apparent from the following specification when taken in conjunction with the accompanying drawings in which:

FIG. 6 is a cross-sectional view taken along the line 6—6 in FIG. 5;

FIG. 7 is a perspective view of the internal spring element of the money clip.

DETAILED DESCRIPTION OF THE INVENTION

Figure 1:
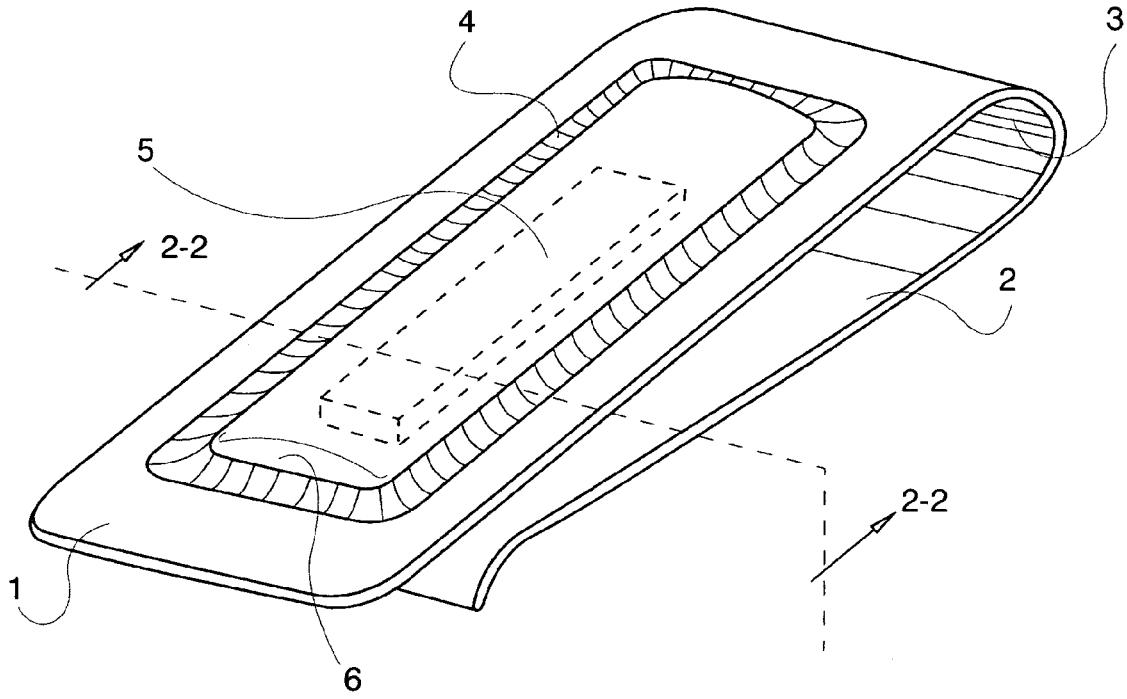
FIG. 1 is a perspective view of a money clip embodying one form of the present invention.

Referring now more particularly to the drawings, and to that embodiment of the invention here presented by way of illustration, FIG. 1 shows a clip made in accordance with the present invention and includes upper and lower jaws 1 and 2 joined by throat 3. Throat 3 is spring loaded to urge jaws 1 and 2 toward each other. It is contemplated that the clip will be used as a money clip normally carried in a person's pocket. Those skilled in the art, however, will realize that this particular use is illustrative only, and the invention is equally applicable to many styles of clips for many different uses.

At least one of the jaws 1 and 2 includes a generally rectangular boss 4. Boss 4 has an inserted or mounted thereon electronic transmitting and receiving device 5 (mounted inside for illustrative purposes in this example). These devices are currently commercially available and are classified as RFID (radio frequency identification devices). Device 5 may be of various shapes and sizes and is shown as an elongated format in the drawings. Boss 4 includes insert 6 that serves as the protective cover over the electronic device installed inside the insert and is permanently attached to the clip within boss 4. Electronic device 5 transmits and receives data information through the materials used in the construction of the insert. One existing application of device 5 is a transmitter marketed under the trademark Speedpass.

In general, device 5 works in conjunction with a transceiver/reader means which creates an electromagnetic field that is variable in size or strength according to its radio frequency and power output. When the money clip with the included radio frequency identification device (RFID) electronic tag is placed within close proximity of the transceiver, passing within the electromagnetic field, the RFID device inside the clip detects the activation signal from the reader. The transceiver/reader then decodes the encoded data in the RFID device's circuitry and the data are then sent to the host computer for appropriate processing as needed. Once the RFID data are verified, the appropriate transaction is then activated and/or completed.

This invention provides a smooth and elegant appearance for the clip, while concealing and protecting the electronic device in a secure and permanent position. The insert also allows the money clip to have the ability to include various types of materials and designs to create an aesthetically pleasing insert that also functions to securely hold the electronic device in its permanent position.

Figure 2:
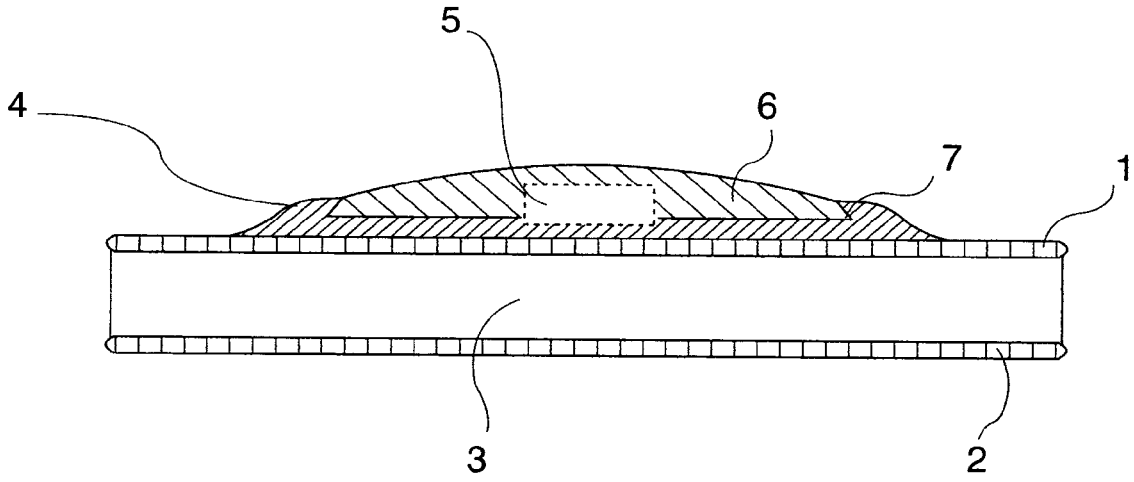
FIG. 2 is a cross-sectional view taken along line 2—2 in FIG. 1.

FIG. 2 shows a cross-sectional view of boss 4 disposed on jaw 1 and insert 6 mounted therein with electronic device 5 seated within boss 4 and insert 6. In this application, there are reversed receiving edges 7, cut into the boss 4, each for a one-way permanent mounting of the insert 6. The design of the insert 6 and the inside area of the boss 4 may each be shaped to fit the dimensions of the electronic device 5, as needed, which may be in several different sizes and configurations. Secure mounting of insert 6 and device 5 can also be achieved with an adhesive such as glue or other suitable means.

Figure 3:
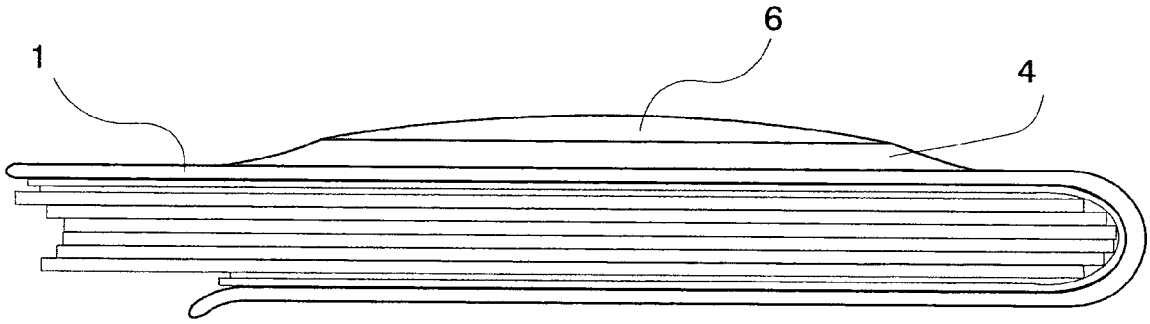
FIG. 3 is a side elevational view of the money clip with currency, credit cards and the like disposed between the jaws of the clip.

Looking at FIG. 3, the drawing illustrates a side view of the money clip with the insert 6, mounted in the boss 4, on the top jaw 1, holding the contents of a money clip consisting of currency folded around a few credit cards, driver's license, etc. This is a side elevational view of a money clip made in accordance with present invention having currency and cards held therein and boss 4 with electronic device 5 included.

A modification of the money clip is shown in FIGS. 4–8 in which upper operating lever 8 is slidably mounted in groove 9 formed in upper boss 10. In similar fashion, lower operating lever 11 is slidably mounted on lower boss 12. Also, bosses 10 and 12 are slidably mounted on and secured, respectively, to upper jaw 13 and lower jaw 14 which are joined by means of throat 15.

As best shown in FIG. 6, transmitting and receiving device 16 is mounted in a recess formed in operating lever 8 and is protectively covered by means of insert 17. In order to enhance the sliding motion of operating levers 8 and 11, internal spring means 18 is secured at the ends thereof between upper jaw 13 and the bottom wall portion of upper boss 10.

As shown in detail in FIG. 7, internal spring means 18 includes sphere 19 which is positioned in beveled orifice 20 with the midportion of spring 18 being disposed in aperture 21 formed in upper jaw 13. Internal spring means 18 acts as tensioning means by asserting an upward force on upper operating lever 8. Sphere 19 facilitates the correct positioning of upper operating lever 8 by means of its sliding movement and frictional tension in longitudinal slot 22 formed on the bottom surface of upper operating lever 8.

Although not shown in detail in the drawings, similar structure as shown in FIG. 6 is associated with lower operating lever 11. Of course, typically only one transmitting and receiving device 16 would be utilized in connection with either the upper or lower operating lever.

Figure 4:
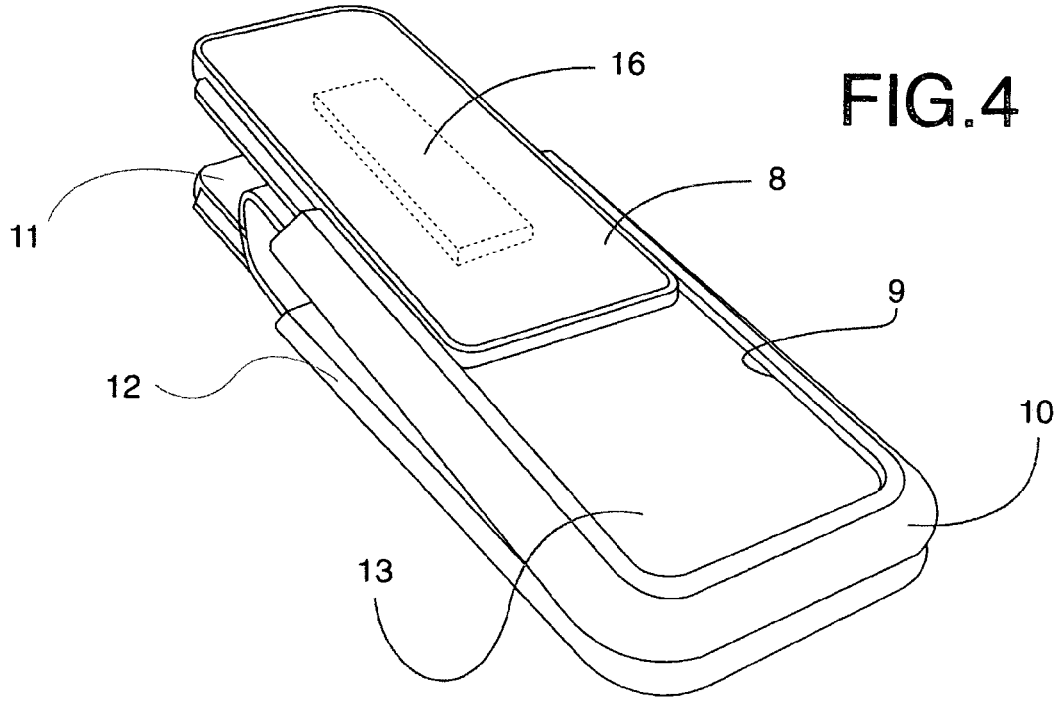
FIGS. 4 and 5 are perspective views showing the clip with operating levers.
Figure 5:
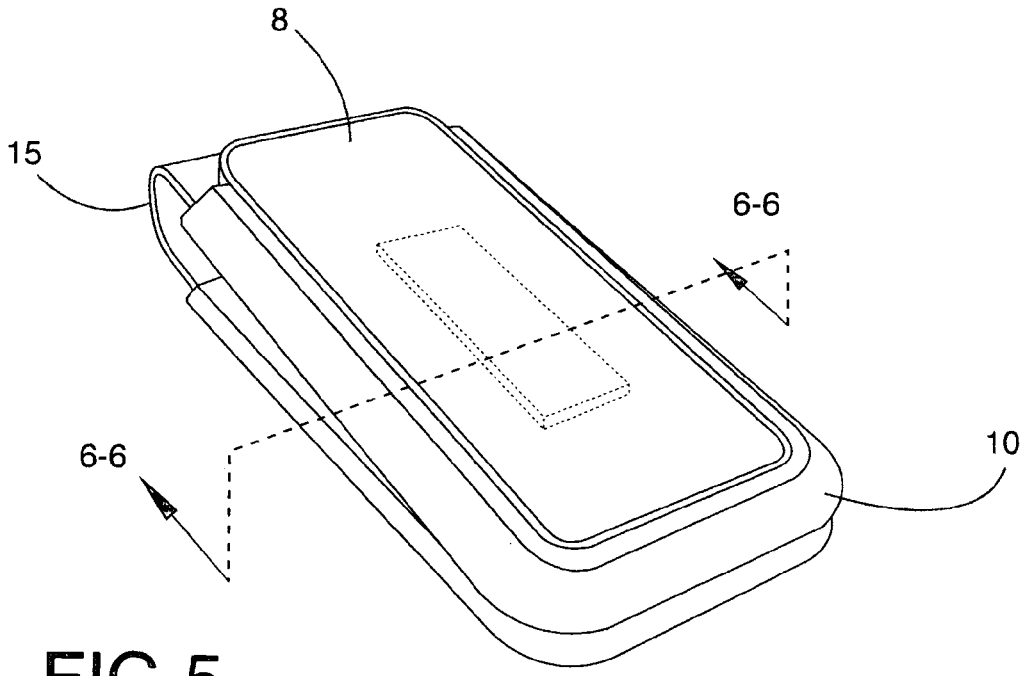
Figure 8:
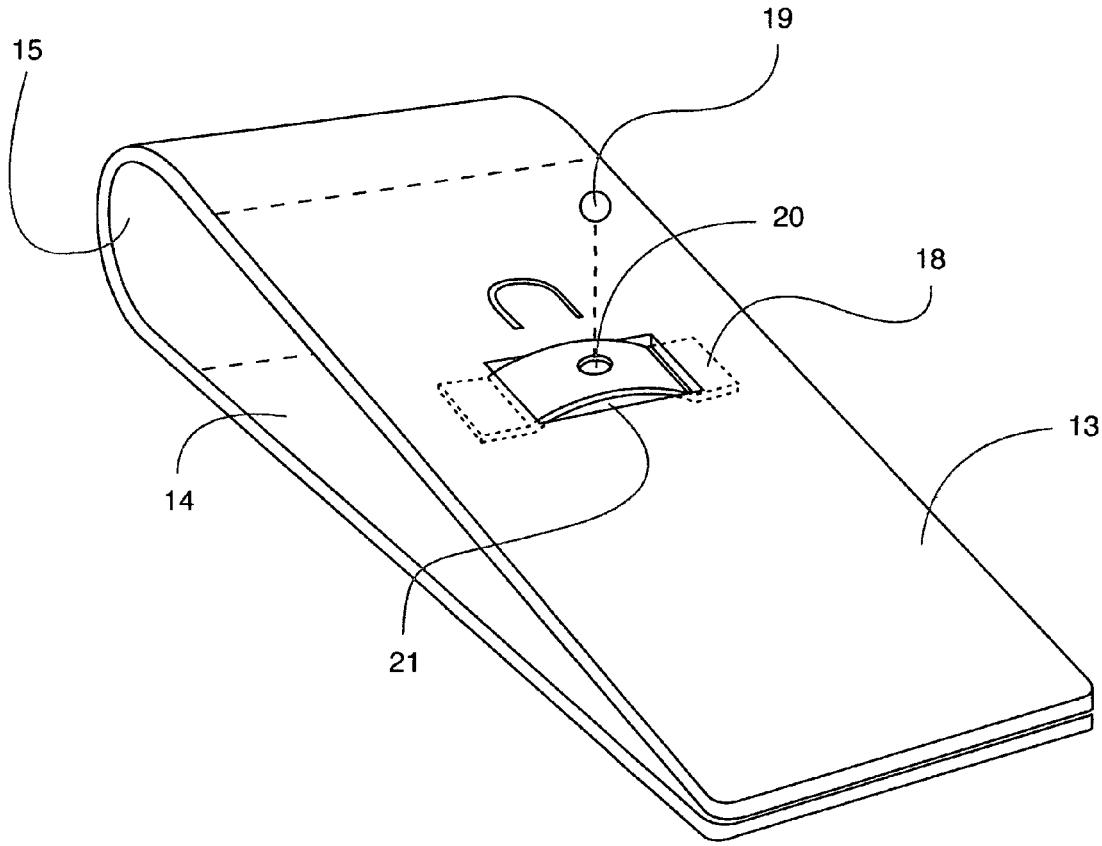
FIG. 8 is a perspective view of the jaws and throat structure of the clip shown in FIGS. 4 and 5.

In operation, items are secured between bosses 10 and 12 by means of operating levers 8 and 11 which are maneuvered from the positions shown in FIG. 5 to the positions shown in FIG. 4. Then operating levers 8 and 11 are simply squeezed together which acts to open bosses 10 and 12 for ease of insertion of items therebetween. In accordance with this invention, device 16 is used for transmitting and receiving electronic data as desired.

It will of course be understood by those skilled in the art that the particular embodiment of the invention here presented is by way of illustration only, and is meant to be in no way restrictive, therefore, numerous changes and modifications may be made, and the full use of equivalents resorted to, without departing from the spirit and scope of the invention as outlined in the appended claims.

What is claimed is:

1. A money clip comprising a pair of equidistant jaws, a throat connected to said jaws to urge said jaws toward each other, a pair of bosses secured respectively to said jaws, a pair of operating levers slidably mounted respectively on said bosses with portions thereof adapted to extend beyond said throat, one of said bosses having a planar bottom portion, said one jaw having spaced generally parallel side edges, an aperture formed in said one jaw intermediate said side edges, an internal spring having a midportion and a pair of ends, said midportion being disposed in said aperture, said ends being disposed between said bottom portion and said jaw respectively on opposite sides of said aperture, and said midportion adapted to apply a tension force on the associated one of said operating levers.

2. A money clip according to claim 1 wherein an aperture is formed in said spring and wherein a sphere is disposed in said aperture.

3. A money clip according to claim 2 wherein said one operating lever comprises a bottom, wherein a slot is formed in said bottom and wherein said sphere is slidably disposed in said slot.

4. A money clip according to claim 1 wherein an electronic transmitting and receiving device is disposed on said operating lever.

5. A money clip according to claim 4 wherein a protective insert is disposed over said device.

* * * * *